US010718334B2

(12) United States Patent
Herlemann et al.

(10) Patent No.: US 10,718,334 B2
(45) Date of Patent: Jul. 21, 2020

(54) COMPRESSOR WITH RIBBED COOLING JACKET

(71) Applicant: Ingersoll-Rand Company, Davidson, NC (US)

(72) Inventors: Sven Herlemann, Datteln (DE); Jan Hauser, Dortmund (DE); Michael Beinert, Dortmund (DE); Philipp Schulze-Beckinghausen, Oberhausen (DE)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 38 days.

(21) Appl. No.: 15/381,334

(22) Filed: Dec. 16, 2016

(65) Prior Publication Data

US 2017/0175744 A1 Jun. 22, 2017

Related U.S. Application Data

(60) Provisional application No. 62/270,273, filed on Dec. 21, 2015.

(51) Int. Cl.

| | |
|---|---|
| ***F04C 29/04*** | (2006.01) |
| ***F28F 3/02*** | (2006.01) |
| ***F28D 9/00*** | (2006.01) |
| ***F04C 18/16*** | (2006.01) |
| ***F01C 21/10*** | (2006.01) |

(52) U.S. Cl.

CPC ..... *F04C 29/04* (2013.01); *F01C 21/10* (2013.01); *F04C 18/16* (2013.01)

(58) Field of Classification Search

CPC ..... F04C 29/04; F04C 29/047; F01C 418/16; F28D 9/0037

USPC ..... 418/101, 83, 91, 201.1, 220

See application file for complete search history.

(56) References Cited

U.S. PATENT DOCUMENTS

| | | | | |
|---|---|---|---|---|
| 2,266,820 | A | 12/1941 | Smith | |
| 2,287,716 | A | 6/1942 | Whitfield | |
| 2,994,508 | A | 8/1961 | Howald | |
| 4,228,657 | A * | 10/1980 | Leo | F01K 7/00 418/83 |
| 5,695,327 | A | 12/1997 | Heinen et al. | |
| 6,118,656 | A * | 9/2000 | Wang | F28F 3/02 257/E23.103 |
| 6,918,749 | B2 | 7/2005 | Garczorz et al. | |

(Continued)

FOREIGN PATENT DOCUMENTS

CN 103867445 A 6/2014

OTHER PUBLICATIONS

The Enginger Toolbox, www.Engineeringtoolbox.com, dated May 24, 2011 by Wayback Machine.*

*Primary Examiner* — Deming Wan

(74) *Attorney, Agent, or Firm* — Taft Stettinius & Hollister LLP

(57) ABSTRACT

The application is directed to a compressor having a housing with a fluid compression region to rotatably support a compressor rotor. The housing includes an inner wall formed as a thin wall positioned about the compression region and an outer wall spaced radially outward of the inner wall. A cooling chamber is formed in a space between the inner and outer walls. A rib formed on the inner wall projects into the cooling chamber to provide structural support and prevent thermal deformation of the thin inner wall during compressor operation.

19 Claims, 4 Drawing Sheets

(56) References Cited

U.S. PATENT DOCUMENTS

| | | | | |
|---|---|---|---|---|
| 7,690,901 | B2 | 4/2010 | Achtelik et al. | |
| 2007/0051495 | A1* | 3/2007 | Hsiao | F28F 3/02 165/80.3 |
| 2014/0322059 | A1 | 10/2014 | Kovacevic et al. | |
| 2015/0118093 | A1* | 4/2015 | Steffens | F04C 18/084 418/91 |

* cited by examiner

COMPRESSOR WITH RIBBED COOLING JACKET

TECHNICAL FIELD

The present disclosure generally relates to industrial air compressor systems and more particularly, but not exclusively, to a compressor having a thin walled cooling jacket with support ribs.

BACKGROUND

Fluid compressors necessarily heat compressible fluid during the compression process. Under some conditions high temperatures can cause portions of the compressor to thermally deform or "warp." Some compressor systems can include cooling means to remove heat from the rotors to prevent a defined temperature from exceeding a threshold limitation. Some existing systems have various shortcomings relative to certain applications. Accordingly, there remains a need for further contributions in this area of technology.

SUMMARY

One embodiment of the present disclosure is a unique compressor system. Other embodiments include apparatuses, systems, devices, hardware, methods, and combinations for compressor systems with a unique cooling jacket. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
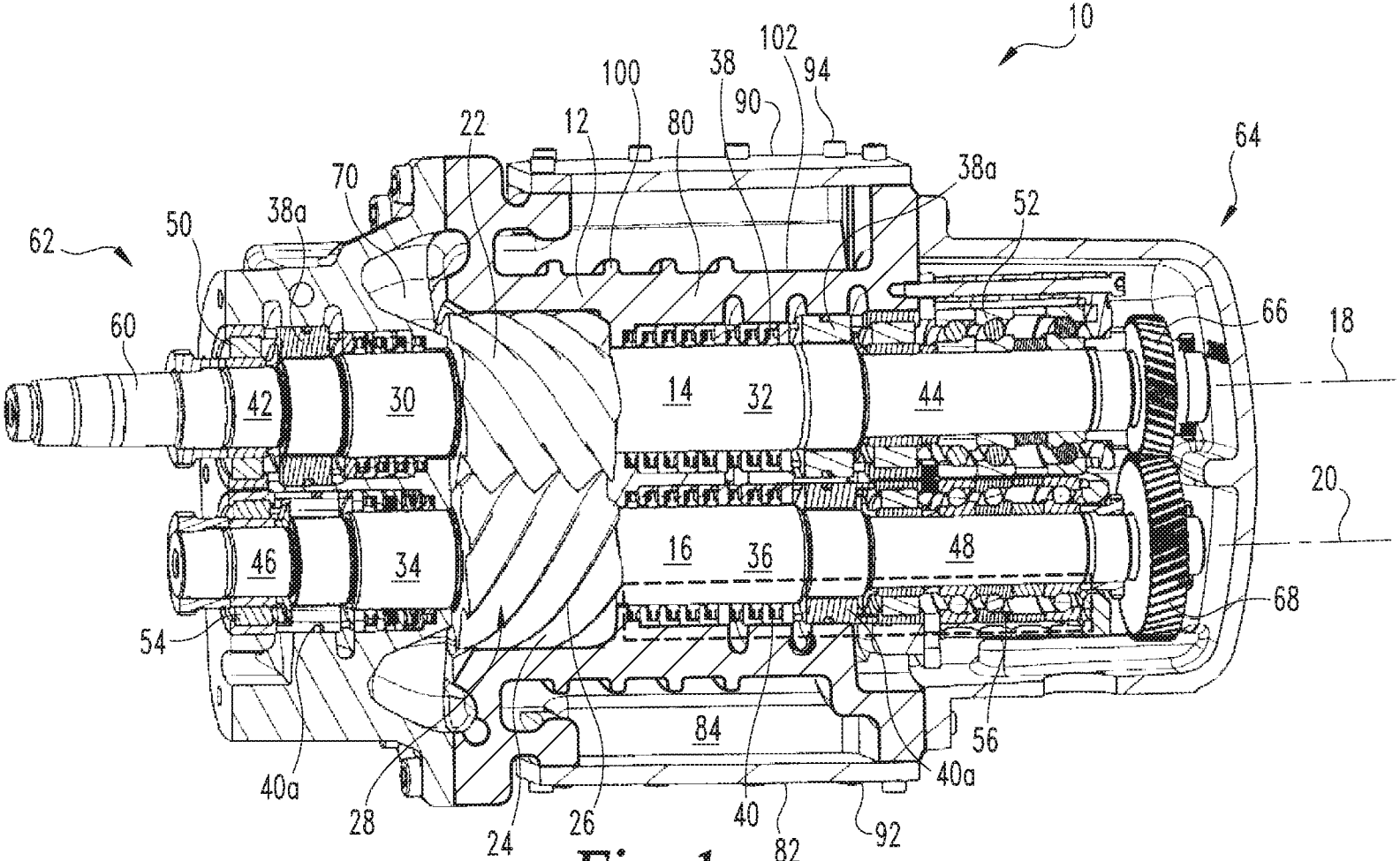
FIG. 1 is a perspective view of a compressor system according to one embodiment of the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Referring now to FIG. 1, a portion of a compressor 10 is depicted in a perspective partially cut-away view to show internal features. In the exemplary embodiment the compressor 10 is a screw compressor, however it should be understood that the teachings of the present application may be used with other compressor types. Such non-limiting examples can include axial, centrifugal, piston, or other types known by those skilled in the art. The compressor 10 can include a rotor housing 12 configured to rotatably support first and second rotors 14, 16 respectively. In alternate forms three or more compressor rotors may be rotatably supported within the rotor housing 12. Each of the rotors 14, 16 are positioned in a common plane and rotate about parallel axes 18, 20 respectively. Each rotor 14, 16 includes a working portion or compressor profile section 22 and 24 that is formed into a helically shaped alternating tooth 26 and groove 28 configuration that define male and female compressor screws. The helically shaped profile sections 22, 24 of the male and female compressor screws mesh with one another to form a sealed compressor flowpath. The working fluid, which can include any compressible fluid such as air or the like, is compressed to a higher pressure along the flowpath and is restricted from leaking from the flowpath prior to exiting through a discharge port (not shown). The term "fluid" should be understood to include any gas or liquid medium that can be used in the compressor system as disclosed herein.

The rotors 14, 16 include shaft seal pins 30, 32 and 34, 36 extending from either side of profile sections 22, 24, respectively. The seal pins 30, 32 and 34, 36 have outer surfaces engaged with seal arrangements 38, 40 operably connected to the housing 12 to form a fluid tight seal between the rotors 14, 16 and the rotor housing 12. Bearing pins 42, 44 and 46, 48 extend from the seal pins 30, 32 and 34, 36 on each of the rotors 14, 16 respectively. The bearing pins 42, 44 and 46, 48 are engaged with bearings 50, 52 and 54, 56 at either end of the rotors 14, 16. The bearings 50, 52 and 54, 56 are operable for supporting high speed rotation of the rotors 14, 16. Rotational speeds can range from hundreds to thousands of revolutions per minute (RPM). The bearings 50, 52 and 54, 56 can be of any suitable type, such non-limiting examples include ball, roller or hydrodynamic sleeve configurations. Due to high rotational speeds, the bearings are typically oil lubricated. To prevent oil from leaking from the bearing section to the compressor section, additional labyrinth seals (38*a*, 40*a*) can be embedded in the compressor 10.

In this exemplary configuration, the primary, or first rotor 14, sometimes referred to as the "male rotor," is the main drive rotor and includes an extension 60 proximate a first end 62 to support a drive gear (not shown) that can be connected to and rotatably driven by a drive shaft or drive transmission unit (also not shown). The primary rotor 14 transmits rotational torque to the secondary rotor 16, sometimes referred to as the "female rotor." Each of the rotors 14, 16 have gears 66 and 68 connected therebetween proximate a second end 64 opposite of the first end 62. The gears 66, 68 are engaged with one another, such that the primary rotor 14 can drive the secondary rotor 16 in synchronized fashion at a desired gear ratio while keeping the male and female screw compressor profile sections 22, 24 in a meshed relationship so as to provide fluid compression means during rotation.

An intake chamber 70 is formed in the housing 12 and is configured to receive a compressible working fluid from a source (not shown) and direct the working fluid into the compression chamber flowpath formed by the meshed compressor profiles 22, 24 during rotating operation. In some embodiments, the working fluid can be compressed to an above ambient pressure prior to entering the intake chamber. The working fluid is compressed to a desired pressure in the compression chamber flowpath and then discharged through an outlet port (not shown). After exiting through the outlet port the compressed fluid can be directed to a cooler, an end use storage tank and/or to another compressor stage (not shown).

The rotor housing 12 can include an inner wall or jacket 80 that surrounds and is closely aligned with an outer surface of portions of the rotors 14, 16. The rotor housing 12 further includes an outer wall or jacket 82 spaced apart from the inner jacket 80 in a radial direction relative to the rotational axes 18 and 20 of the rotors 14, 16 respectively. A cooling chamber 84 is formed in the space between the inner and outer jackets 80, 82 wherein a cooling fluid such as a water based coolant, a petroleum based fluid or other suitable heat transfer fluids can be circulated to receive and remove heat generated by the compression process of the compressible working fluid. In some forms the cooling chamber 84 may be an annular chamber that completely surrounds at least portions of the rotors 14, 16 however, in alternate forms the cooling chamber may not completely surround one or both of the rotors 14, 16. Furthermore, the cooling chamber 84 may be separated into a plurality of discreet flowpaths separated by partition walls (not shown) or other types of flow dividers (also not shown). In some forms the inner and outer jackets 80, 82 are integrally formed together such as for example by a casting process or machined process of a forged billet. In other forms the inner and outer jackets may be separately formed and joined together via mechanical fastener means, e.g. weld, bolt, screw, adhesive etc. In some forms the outer jacket 82 may include one or more removable cover plates such as a top cover plate 90 and/or a bottom cover plate 92 to permit access to internal areas of the housing 12. The cover plates 90, 92 can be connected to the housing 12 in a sealed manner with threaded fasteners 94 and optional seals or gaskets (not shown).

In some aspects reducing the wall thickness of at least portions of the inner jacket 80 will promote an increase in heat transfer from the heat source to the cooling fluid in the cooling chamber 84. However reducing the wall thickness below a minimum threshold will cause the inner jacket to warp or yield due to thermal deformation under certain operating conditions of the compressor. This minimum threshold thickness is defined as a "thin walled" structure or configuration. The actual wall thickness dimension of a thin walled housing may vary depending on the type of metal or metal alloy that is used. However, the definition for the minimum threshold thickness remains consistent and is defined as the thickness required to prevent thermal deformation of the wall under all operating conditions of the compressor 10.

In order to promote heat transfer through the inner jacket 82, the wall thickness can be configured as a "thin walled" structure that would otherwise warp or deform under the thermal loads generated by the compressor 10, but for the addition of one or more stiffening ribs 100. The one or more ribs 100 are constructed to provide mechanical stiffening and prevent deformation due to thermal strain on the thin walled inner jacket 80. The one or more ribs 100 generally extend from an outer surface 102 of the inner jacket 80 toward the cooling chamber 84. The orientation of the ribs 100 may extend in a circumferential orientation around the rotors 12, 14 as depicted in the exemplary embodiment, in an axial direction generally parallel to the axes of rotation 18, 20, a transverse direction or combinations of any of the above.

By providing a thin walled inner jacket 80 an increased level of heat transfer may be conveyed to the cooling chamber 84. However, without the addition of structural ribs 100, the thin walled inner jacket 80 would deform or permanently yield under certain operating conditions of the compressor 10. The ribs 100 will permit design clearances between the rotors 14, 16 and the inner jacket 80 to be minimized while preventing mechanical interference or rubbing due to thermal deformation of the inner jacket 80. Minimized clearances between the inner jacket 80 and the rotors 14, 16 provide for higher compressor efficiency and thus lower operation costs.

Figure 2:
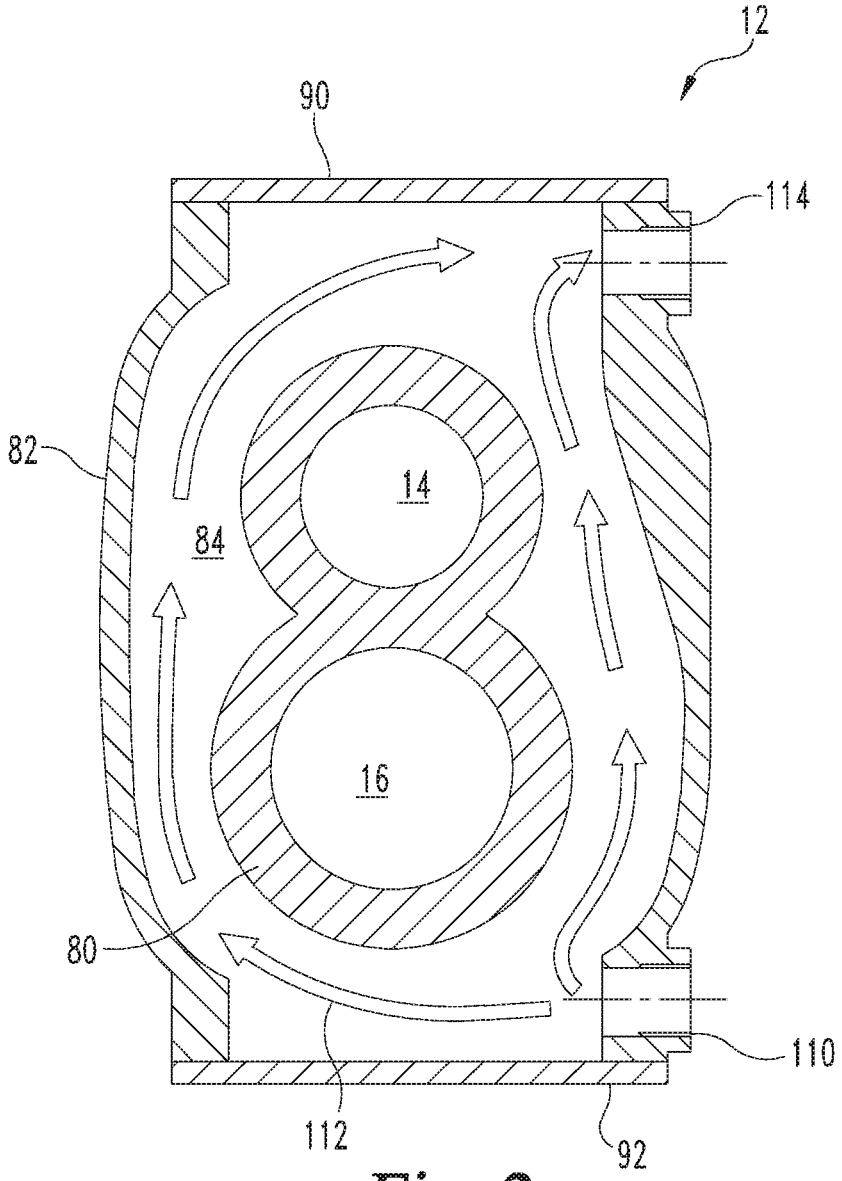
FIG. 2 is a cross-sectional view of a portion of the compressor system of FIG. 1.

Referring now to FIG. 2, a cross-sectional view of the rotor housing 12 is shown in one form. The inner jacket wall 80 can include portions having varying thicknesses or configurations and can include ribbed portions (not shown) as will be described in more detail below. The outer jacket wall 82 can be spaced radially apart from the inner jacket wall 80 to form a cooling chamber 84 therebetween as shown. The rotor housing 12 can include a removable top cover plate 90 and/or a bottom cover plate 92 in some embodiments. In other embodiments the rotor housing may not include removable cover plates. One or more coolant inlet ports 110 can be formed with the outer wall 82 to permit coolant depicted by arrows 112 to flow into the cooling chamber 84. The coolant 112 can be directed in various pathways and directions and need not follow the exemplary flow path as depicted in FIG. 2. The coolant 112 can then exit from one or more coolant outlet ports 114 as illustrated in the exemplary embodiment.

Figure 3:
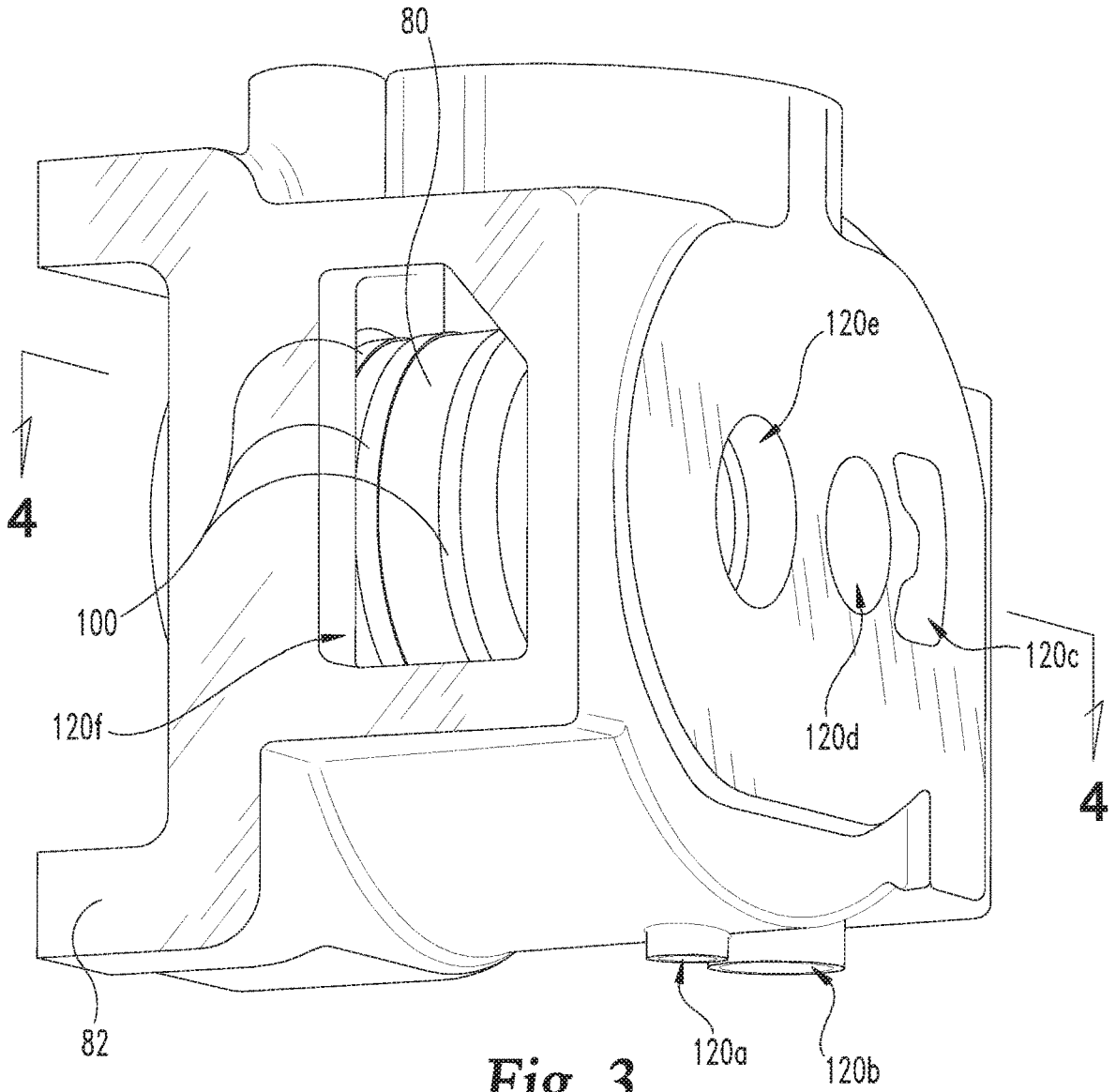
FIG. 3 is perspective view of a portion of the compressor system of FIG. 1 showing a housing with a ribbed cooling jacket.

Referring now to FIG. 3, a perspective view of the portion of the outer jacket wall 82 and inner jacket wall 80 of the compressor housing is shown. The outer wall 82 can include a plurality of various apertures such as those depicted at 120*a*, 120*b*, 120*c*, 120*d*, 120*e*, and 120*f*. These apertures can be configured to receive or provide access to various components or features such as by way of example and not limitation, rotating or fixed shafts, lubricant ports, coolant ports, maintenance access ports or other features as would be known to one skilled in the art. The inner jacket 80 as viewed through the aperture 120*f* can include one or more ribs 100 extending from the inner jacket 80 toward the outer jacket 82.

Figure 4:
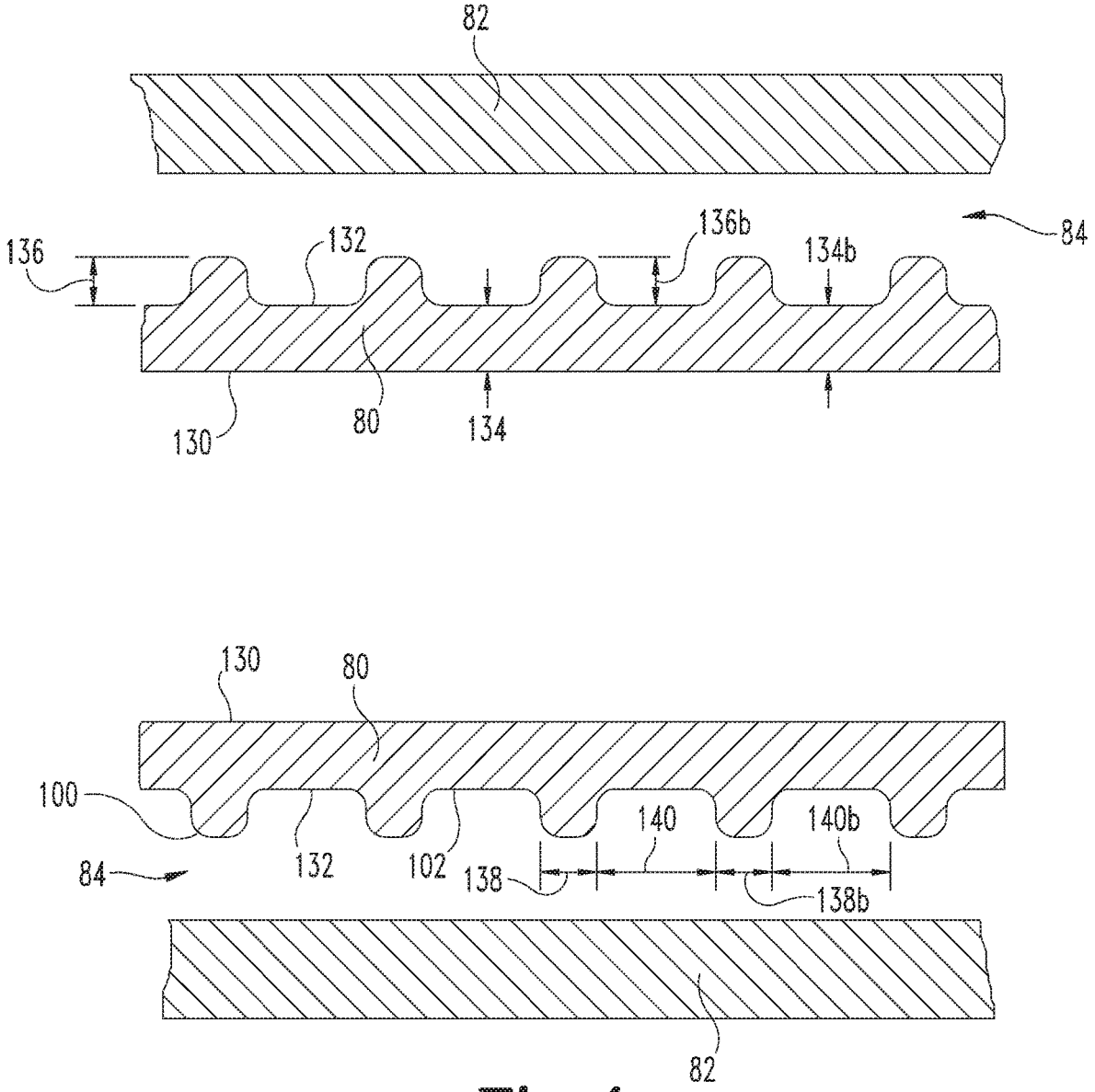
FIG. 4 is a cross-sectional view of the housing and ribbed cooling jacket of FIG. 3 taken along line 4-4.

Referring now to FIG. 4, a cross-sectional view taken along line 4-4 in FIG. 3 is shown. The outer jacket wall 82 surrounds the inner jacket wall 80 at a radially displaced location. The inner jacket wall 80 can include an inner surface 130 that surrounds rotors 14, 16 (not shown). The inner jacket 80 includes an outer surface 132 spaced apart from an inner surface 130 to define a wall thickness delineated by paired arrows 134. The wall thickness 134 defines a thin wall, which has previously been defined as a thickness that would permit thermal deformation at certain compressor operating conditions, but for the stiffening support of one or more ribs 100. Portions of the inner jacket wall 80 can include thin walled portions having varying thicknesses relative to other portions such as that schematically illustrated by paired arrows labeled as 134*b*. Thin wall 134*b* is indicative of a different thin wall thickness relative to the thin wall thickness 134.

The ribs 100 can be defined by a height illustrated by paired arrows 136. The height is that portion of the rib that extends radially outward from the outer surface 132 of a thin wall portion 134. One or more of the ribs 100 can include different heights relative to other ribs 100 which is schematically illustrated by paired arrows 136*b*. The ribs 100 can also be defined by a width as illustrated by paired arrows 138. One or more of the ribs 100 can have a different width to that of other ribs 100 as is illustrated by paired arrows 138*b*. A width or distance of the thin walled portion between adjacent pairs of ribs 100 can be defined by paired arrows 140. One or more of the distances between different pairs of adjacent ribs 100 can be different relative to other locations as is schematically illustrated by paired arrows 140*b*. In one form one or more ribs 100 may be integrally formed with the thin wall of the inner jacket 80 and in other forms one or more ribs 100 may be formed separately and subsequently attached via mechanical means such as by way of example and not limitation, weld, threaded fastener, rivet, adhesive, press fit, etc. In some forms the ribs 100 may be made from a different material than the thin walled inner jacket. Materials selection can include metals, metal alloys, composites, plastics, and combinations thereof.

In operation the compressor system is configured to provide compressed gas such as air at a desired temperature and pressure to external systems. The compressor systems can be used in any industrial application including but not limited to automobile manufacturing, textile manufacturing, process industries, refineries, power plants, mining, material handling, etc. A controller (not shown) can be operably coupled to the compressor to receive operator input and to transmit command outputs to various valve systems and actuators (not shown) to define working fluid parameters including pressure, temperature and mass flow rate. The controller can send command signals to a motive source (not shown) to rotate at a desired operating speed in order to drive the compressor, control various valving systems and fluid pumps (not shown) to control airflow rate, coolant flow rate and/or lubrication flow rates.

In one aspect, the present disclosure includes compressor comprising a structure configured to support a compressor rotor; fluid compression means coupled to the compressor rotor; a cooling chamber formed within the structure about a portion of the compressor rotor, the cooling chamber configured to contain a cooling fluid; an inner cooling jacket wall and outer cooling jacket wall defining inner and outer walls respectively of the cooling chamber; a plurality of ribs formed with the inner cooling jacket wall, the ribs defined by portions of the inner cooling jacket wall projecting radially outward toward the cooling chamber.

In refining aspects, the present disclosure includes wherein the ribs of the inner cooling jacket wall define a wall thickness that is greater than a wall thickness of the inner jacket wall at other locations; portions of the inner jacket wall between adjacent ribs have a thickness defined as a thin walled structure; a cooling fluid is disposed within the cooling chamber; the cooling fluid includes one of a water based solution and an oil based solution; portions of the inner jacket wall having ribs formed thereon is more than twice the thickness of the non-ribbed portions; portions of the inner jacket wall having ribs formed thereon is less than twice the thickness of the non-ribbed portions; a width of the ribs is greater than a width of the portion of the inner jacket between adjacent pairs of ribs; a width of the ribs is less than a width or distance of the portion of the inner jacket between adjacent pairs of ribs; the compression means includes a screw compressor; the ribs are oriented in one of a circumferential direction, an axial direction, a transverse direction or combinations thereof relative to an axis of rotation.

In another aspect the present disclosure includes an apparatus comprising: a housing having a fluid compression cavity; at least one compressor rotor rotatably supported at least partially within the compression cavity; an inner wall encompassing the compression cavity, wherein the inner wall includes a portion defined as a thin walled structure; and an outer wall spaced radially outward of the inner wall; a cooling chamber formed in a space between the inner and outer walls; and a plurality of ribs formed on the inner wall projecting into the cooling chamber.

In refining aspects, the present disclosure includes the ribs are integrally formed with the inner wall; the ribs are separately formed and attached to the inner wall; a width of at least one rib is greater than a width defined between a pair of adjacent ribs; a height of at least one rib extending in a radial direction from a surface of the inner wall is greater than a wall thickness of the inner wall between an adjacent pair of ribs; a height of at least one rib extending in a radial direction from a surface of the inner wall is less than a wall thickness of the inner wall between an adjacent pair of ribs; the compressor rotor includes a screw profile section operable for compressing a fluid.

In another aspect, the present disclosure includes a method comprising forming a compressor housing with an inner jacket and an outer jacket; assembling a compressor rotor radially inward of the inner jacket; forming structural ribs on a portion of the inner jacket, wherein a portion of the inner jacket between an adjacent pair of ribs define a thin walled structure; forming a coolant flow channel between the inner and outer jackets; and flowing cooling fluid through the flow channel and across the ribs to remove heat generated by an operating compressor.

In refining aspects, the method includes ribs integrally formed with the inner jacket; or the ribs and the inner jacket are separately formed and subsequently attached.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A method comprising:

forming a compressor housing with an inner jacket and an outer jacket;

assembling a compressor rotor radially inward of the inner jacket;

forming a structural rib on a portion of the inner jacket, wherein a non-ribbed portion of the inner jacket has a thickness defined as a thin walled structure, wherein the thin walled structure includes a thickness such that the thickness if extended across an axial length of the inner jacket wall would, in the absence of the one or more ribs, result in at least one of (1) warping of the inner jacket wall during operation of a compressor having the compressor housing, (2) yielding of the inner jacket wall during operation of a compressor having the compressor housing, (3) mechanical interference between the compressor rotor and the inner jacket wall during operation of a compressor having the compressor housing, and (4) rubbing between the compressor rotor and the inner jacket wall during operation of a compressor having the compressor housing; and forming a coolant flow channel between the inner and outer jackets.

2. The method of claim 1, wherein the rib and the inner jacket are separately formed and subsequently attached.

3. A compressor comprising:

a housing structure configured to support a compressor rotor, the compressor rotor structured to increase a pressure of a working fluid;

a cooling chamber formed within the housing structure about a portion of the compressor rotor, the cooling chamber configured to contain a cooling fluid;

an inner cooling jacket wall and outer cooling jacket wall defining inner and outer walls respectively of the cooling chamber; and a plurality of ribs formed with the inner cooling jacket wall, the ribs defined by portions of the inner cooling jacket wall projecting radially outward toward the cooling chamber;

wherein portions of the inner jacket wall between the adjacent ribs have a thickness such that the thickness if extended across an axial length of the inner jacket wall would, in the absence of the plurality of ribs, result in at least one of (1) warping of the inner jacket wall during operation of the compressor rotor; (2) yielding of the inner jacket wall during operation of the compressor rotor; (3) mechanical interference between the compressor rotor and the inner jacket wall during operation of a compressor having the compressor housing; and (4) rubbing between the compressor rotor and the inner jacket wall during operation of a compressor having the compressor housing.

4. The compressor system of claim 3, wherein the ribs of the inner cooling jacket wall define a wall thickness that is greater than a wall thickness of the inner jacket wall at other locations.

5. The compressor system of claim 3, wherein a cooling fluid is disposed within the cooling chamber to receive and remove heat from the compressor.

6. The compressor system of claim 5, wherein the cooling fluid includes one of a water based solution and an oil based solution.

7. The compressor system of claim 3, wherein portions of the inner jacket wall having the ribs formed thereon is more than twice a thickness of the non-ribbed portions.

8. The compressor system of claim 3, wherein portions of the inner jacket wall having the ribs formed thereon is less than twice a thickness of the non-ribbed portions.

9. The compressor system of claim 3, wherein a width of at least one of the ribs is greater than a distance between an adjacent pair of ribs.

10. The compressor system of claim 3, wherein a width of at least one of the ribs is less than a distance between an adjacent pair of ribs.

11. The compressor system of claim 3, wherein the compressor rotor is in the form of a screw compressor.

12. The compressor system of claim 3, wherein the ribs are oriented in one of a circumferential direction, a transverse direction or combinations thereof relative to an axis of rotation.

13. An apparatus comprising:

a housing including a fluid compression cavity;

a compressor rotor rotatably supported at least partially within the fluid compression cavity;

an inner wall encompassing the fluid compression cavity, wherein the inner wall includes a portion defined as a thin walled structure; and an outer wall spaced radially outward of the inner wall;

a cooling chamber formed in a space between the inner and outer walls; and one or more ribs formed on the inner wall projecting into the cooling chamber;

wherein the thin walled structure includes a thickness such that the thickness if extended across an axial length of the inner jacket wall would, in the absence of the one or more ribs, result in at least one of (1) warping of the inner jacket wall during operation of the compressor rotor; (2) yielding of the inner jacket wall during operation of the compressor rotor; (3) mechanical interference between the compressor rotor and the inner jacket wall during operation of the compressor rotor; and (4) rubbing between the compressor rotor and the inner jacket wall during operation of the compressor rotor.

14. The apparatus of claim 13, wherein each of the one or more ribs is integrally formed with the inner wall.

15. The apparatus of claim 13, wherein each of the one or more ribs is separately formed and attached to the inner wall.

16. The apparatus of claim 13, wherein a width of at least one of the one or more ribs is greater than a distance defined between a pair of adjacent ribs.

17. The apparatus of claim 13, wherein a height of at least one rib extending in a radial direction from a surface of the inner wall is greater than a wall thickness of the inner wall between an adjacent pair of ribs.

18. The apparatus of claim 13, wherein a height of at least one rib extending in a radial direction from a surface of the inner wall is less than a wall thickness of the inner wall between an adjacent pair of ribs.

19. The apparatus of claim 13, wherein the compressor rotor includes a screw profile section operable for compressing a fluid.

* * * * *